US006982401B2

(12) United States Patent
Hu et al.

(10) Patent No.: US 6,982,401 B2
(45) Date of Patent: Jan. 3, 2006

(54) MICROWAVE OVEN

(75) Inventors: Jin Yul Hu, Seoul (KR); Kwong Yong Kim, Seoul (KR); Won Hui Lee, Seoul (KR); Eung Su Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/917,365

(22) Filed: Aug. 13, 2004

(65) Prior Publication Data

US 2005/0184067 A1 Aug. 25, 2005

(30) Foreign Application Priority Data

Feb. 19, 2004 (KR) ..... 10-2004-0011018

(51) Int. Cl.
*H05B 6/72* (2006.01)
*H05B 6/74* (2006.01)

(52) U.S. Cl. ..... 219/746; 219/751; 219/754

(58) Field of Classification Search ..... 219/746–751, 219/753–754, 695–697, 756
See application file for complete search history.

(56) References Cited

U.S. PATENT DOCUMENTS

| | | | | |
|---|---|---|---|---|
| 4,336,434 | A | 6/1982 | Miller | |
| 5,352,873 | A * | 10/1994 | Carlsson et al. | 219/750 |
| 5,468,940 | A * | 11/1995 | Kang | 219/746 |
| 6,057,535 | A | 5/2000 | Derobert et al. | |
| 6,452,143 | B1 * | 9/2002 | Choi | 219/753 |
| 2002/0158066 | A1 | 10/2002 | Dorr et al. | |

FOREIGN PATENT DOCUMENTS

| | | | |
|---|---|---|---|
| EP | 0 344 438 | * | 12/1989 |
| EP | 1 272 009 A2 | | 1/2003 |
| GB | 2098838 A | | 11/1982 |
| JP | 52-23744 | * | 2/1977 |
| JP | 52-36347 | * | 3/1977 |
| JP | 63-279595 | * | 11/1988 |

* cited by examiner

*Primary Examiner*—Philip H. Leung
(74) *Attorney, Agent, or Firm*—Birch, Stewart, Kolasch & Birch, LLP

(57) ABSTRACT

Microwave oven including a cavity for placing food therein, a magnetron for generating a microwave, a waveguide having at least two slots for guiding the microwave from the magnetron to an inside of the cavity, and a stirrer fan rotatably mounted on an inside of the cavity for varying an interfered state of the microwaves periodically, thereby heating the food more uniformly.

10 Claims, 3 Drawing Sheets

MICROWAVE OVEN

This application claims the benefit of the Korean Application No. P2004-0011018 filed on Feb. 19, 2004, which is hereby incorporated by reference.

BACKGROUND OF THE INVENTION

1. Field of the Invention

The present invention relates to microwave ovens, and more particularly, to a microwave oven which can heat food more uniformly.

2. Description of the Related Art

In general, the microwave oven (MWO) cooks food using heat from intermolecular friction caused by disturbance of molecular array of the food at direction of a microwave (2,450 MHz) to the food.

The microwave oven is provided with a cavity for heating the food, and a magnetron on one side of the cavity for generating the microwave. The microwave has a particular resonance mode within the cavity. Energy of the microwave is concentrated at a certain part of an inside of the cavity. Therefore, for uniform heating of the food, particular methods are required. The methods are a first method in which food is moved within the cavity, and a second method in which a radiation condition of the microwave is varied.

In the first method, the food moves along an inside of the cavity having a non-uniform microwave energy formed therein. As a typical example of the first method, in a turn table method, a turn table having the food placed thereon is rotated. The circling food is uniformly heated in a circumferential direction. However, a radial direction heating of the food is not uniform.

In the meantime, in the second method, a mode of the microwave directed to an inside of the cavity is varied, for preventing the microwave from keep focused on a part. As typical examples of the second methods, there are methods using a stirrer fan or a rotating antenna. In those methods, an emission condition of the microwave energy to the inside of the cavity through a waveguide is varied, to emit microwave of a variety of modes.

In the meantime, an OTR (Over The Range) type of microwave oven has a hood over the microwave oven. The OTR type of microwave oven is used as a built-in type microwave oven that is built-in kitchen furniture.

Because the kitchen furniture is installed along a wall surface of the room, a size of the kitchen furniture is limited. In general, since the microwave is extended in a lateral direction due to such a limit, the cavity formed therein has a large width, and a depth smaller than the width.

If the turntable is mounted on an inside of the cavity, a radius of the turn table is limited by the depth of the cavity. Therefore, the mounting of the turn table on the OTR type of microwave oven is not desirable in view of utilization of a space. The OTR type of microwave oven is provided with an oblong dish extended in a lateral direction to the inside of the cavity, which is not rotatable.

Accordingly, it is preferable that the dish in the cavity for placing the food thereon makes, not a rotating movement, but linear reciprocating movement. A microwave oven of which dish makes liner reciprocating movement is called as a side by side type microwave oven.

However, the side by side type of microwave oven has the following problems.

The side by side type of microwave oven has very small stroke of liner movement. Therefore, despite of emission of microwaves of a variety of modes to the inside of the cavity, it is liable that the food is heated non-uniformly compared to the turn table.

Moreover, even in a case the stirrer fan is rotated to vary a microwave pattern, it is difficult of solve the problem of the non-uniformity of the heating pattern due to above reason.

SUMMARY OF THE INVENTION

Accordingly, the present invention is directed to a microwave oven that substantially obviates one or more of the problems due to limitations and disadvantages of the related art.

An object of the present invention is to provide a microwave oven which can make uniform heating of food in a cavity.

Additional features and advantages of the invention will be set forth in the description which follows, and in part will be apparent to those having ordinary skill in the art upon examination of the following or may be learned from practice of the invention. The objectives and other advantages of the invention will be realized and attained by the structure particularly pointed out in the written description and claims hereof as well as the appended drawings.

To achieve these objects and other advantages and in accordance with the purpose of the present invention, as embodied and broadly described herein, the microwave oven including a cavity for placing food therein, a magnetron for generating a microwave, a waveguide having at least two slots for guiding the microwave from the magnetron to an inside of the cavity, and a stirrer fan rotatably mounted on an inside of the cavity for varying an interfered state of the microwaves, periodically.

The slots are formed near peak points of intensity of the magnetic field in the waveguide. Preferably, the slots on both sides of the stirrer fan are formed near $\lambda g/2$ intervals, where $\lambda g$ denotes a wavelength of the microwave in the waveguide.

The stirrer fan has a rotation shaft passed through the waveguide.

The stirrer fan has a rotation shaft provided near a peak point of intensity of an electric field in the waveguide. The rotation shaft is provided near a central part of one side of the cavity. It is preferable that the rotation shaft of the stirrer fan has approximately $\lambda g/4$ distance to an adjacent slot, where $\lambda g$ denotes a wavelength of the microwave in the waveguide.

The cavity includes a tray provided therein for making linear reciprocating movement along one direction. The slots are arranged along one direction, and the microwave oven further includes a dish provided on the tray.

The slot has a 'T' form, or an 'L' form. Or the slot may have a straight line form with a predetermined width, or any arbitrary modified shape.

In other aspect of the present invention, there is provided a microwave oven including a cavity for placing food therein, a magnetron for generating a microwave, and a waveguide having at least two slots for guiding the microwave from the magnetron to an inside of the cavity.

The slots are arranged in a longitudinal direction of the cavity such that the microwaves radiated through the slots make inference with one another to form microwave circles along the longitudinal direction, regularly.

The slots are formed near peak points of intensity of a magnetic field formed in the waveguide near $\lambda g/2$ intervals, where kg denotes a wavelength of the microwave in the waveguide.

The microwave oven further includes a stirrer fan rotatably mounted near a central part of one side of the cavity for varying an interfered state of the microwaves radiated through the slots. The stirrer fan has a rotation shaft provided to pass through nearly a middle part of adjacent slots.

The stirrer fan has a rotation shaft provided near a peak point of intensity of the electric field in the waveguide, and the rotation shaft of the stirrer fan has approximately λg/2 distance to an adjacent slot, kg denotes a wavelength of the microwave in the waveguide.

It is to be understood that both the foregoing description and the following detailed description of the present invention are exemplary and explanatory and are intended to provide further explanation of the invention claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention.

In the drawings.

DETAILED DESCRIPTION OF THE PREFERRED EMBODIMENT

Reference will now be made in detail to the preferred embodiments of the present invention, examples of which are illustrated in the accompanying drawings FIGS. 1 to 3. In describing the embodiment, identical parts will be given the same names and reference symbols, and repetitive description of which will be omitted.

Figure 1:
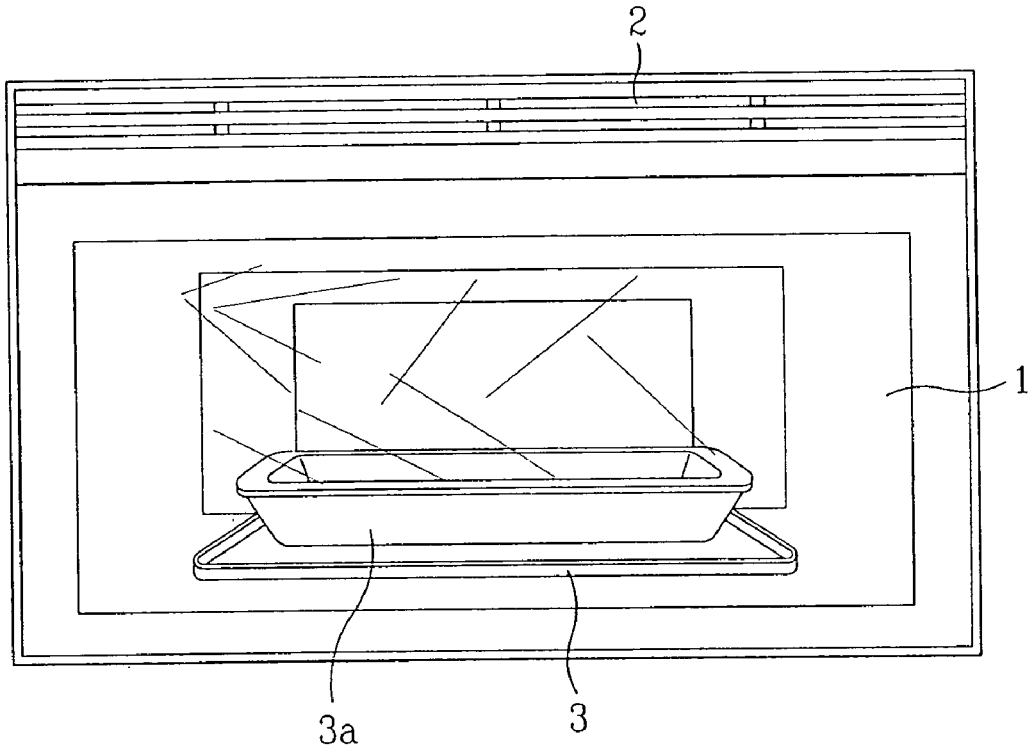
FIG. 1 illustrates a front view of a microwave oven in accordance with a preferred embodiment of the present invention.
Figure 2:
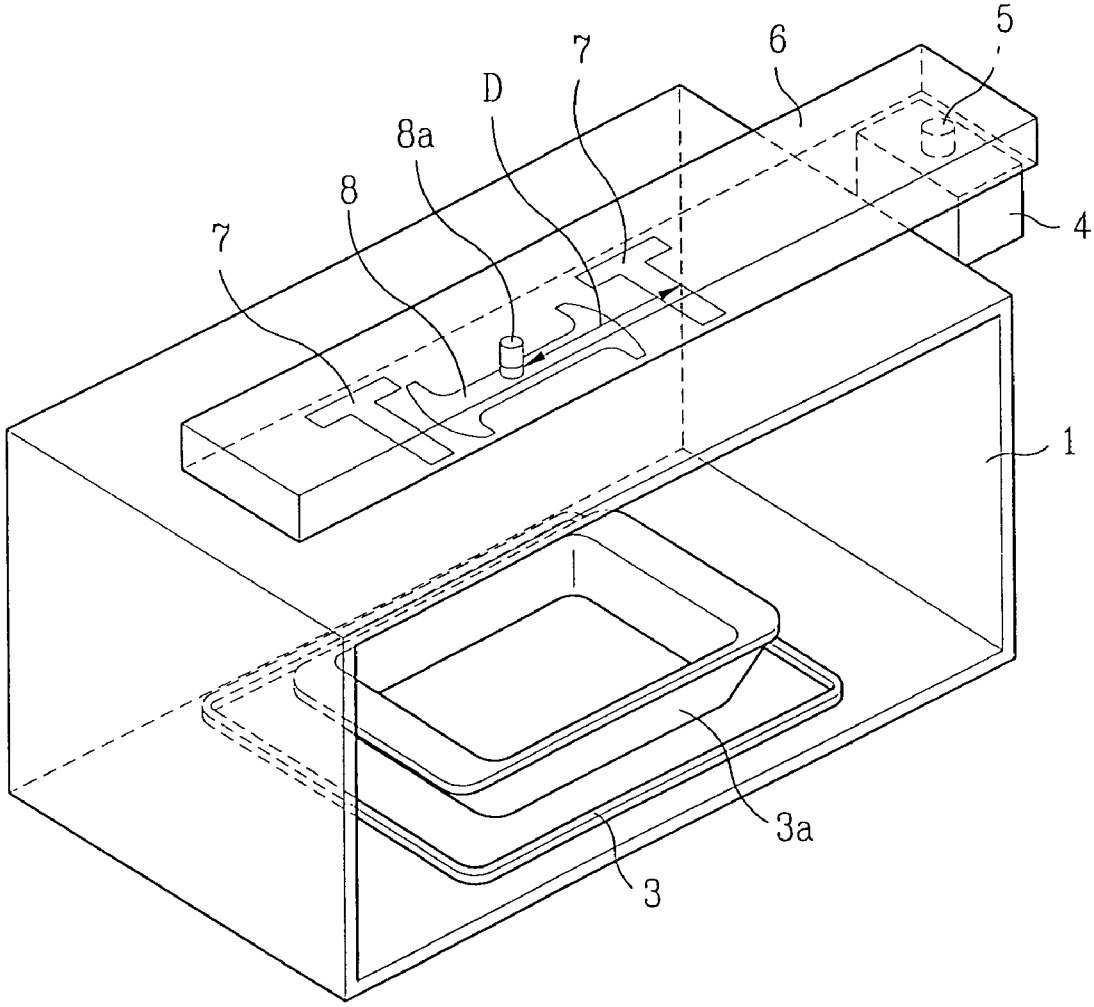
FIG. 2 illustrates a perspective view of a microwave oven in accordance with a preferred embodiment of the present invention.

FIG. 1 illustrates a front view of a microwave oven in accordance with a preferred embodiment of the present invention, and FIG. 2 illustrates a perspective view of a microwave oven in accordance with a preferred embodiment of the present invention.

Referring to FIGS. 1 and 2, the microwave oven includes a cavity 1, a tray 3, a magnetron 4, and a waveguide 6. The microwave oven may further include a stirrer fan 8. Inside surfaces of the cavity 1 and the waveguide 6 are formed of materials that reflect the microwave.

The cavity 1 has a tray 3 mounted on an inside bottom thereof to make linear reciprocating movement, and a dish 3*a* on the tray 3 for placing food thereon.

In general, the side by side type microwave oven is built-in at one side of kitchen furniture. Since the kitchen furniture is installed along a wall surface of a room, a size of the microwave oven is limited. In general, since the microwave oven is extended in a lateral direction due to such a limit, the cavity formed therein has a large width, and a depth smaller than the width.

Thus, as the cavity has a large width, and a depth smaller than the width, the tray 3 is mounted to make reciprocating movement in a lateral direction.

In the meantime, the magnetron 4 is mounted on one side of outside of the cavity 1, and connected to the waveguide 6. In more detail, an antenna part 5 of the magnetron is inserted to one end of the waveguide 6 for emitting the microwave therein.

Referring to FIG. 2, the waveguide 6 is in communication with the inside space of the cavity 1. The waveguide 6 may be mounted, not only on the upper surface of the cavity, but also at one side or on the bottom of the cavity.

In the meantime, the microwave from the magnetron 4 forms a magnetic field and an electric field crossing each other within the waveguide 6. In this instance, each of the fields has a periodic intensity of a sinusoidal wave.

The cavity 1 has at least two slots 7. The waveguide 6 is in communication with the inside space of the cavity 1 through the slots 7. Therefore, the microwave from the magnetron 4 is radiated toward the inside of the cavity 1 through the slots 7. The microwave radiated through the slots 7 interferes with each other.

Moreover, the stirrer fan 8 is rotatably mounted on one side of the cavity 1 through the waveguide 6. The stirrer fan has a rotation shaft 8*a* connected to a motor (not shown). The stirrer fan 8 induces and radiates the electric field formed in the waveguide 6. According to this, an interference state of the microwaves having a variety of modes radiated through the slots 7, and modes varied periodically by the stirrer fan varies periodically.

Therefore, by configuring the slots 7 and the stirrer fan 8 harmoniously, microwaves of more various modes can be formed inside of the cavity 1. Configuration of the slots and the stirrer fan will be described in more detail.

The microwave from the magnetron is superimposed with a wave reflected at an inside surface of the waveguide. The superimposed wave is called as a standing wave, and have a wavelength of λg/2. The 'λg' is a wavelength of a proceeding mode formed in the waveguide 6.

It is preferable that the slots 7 are formed near points where intensity of the magnetic field in the standing wave formed in the waveguide 6 is nearly peak.

The intensity of the microwave radiated into the cavity through the slots is proportional to the intensity of magnetic field of the standing wave. Therefore, it is preferable that the slots 7 are formed at peak points of the intensity of the magnetic field, respectively. That is, as the peak points of the intensity of the magnetic field are near λg/2 intervals, the slots are formed near λg/2 intervals.

Moreover, the shaft 8*a* of the stirrer fan passed through the waveguide 6 is at a point where the electric field of the standing wave formed in the waveguide is the maximum. That is, the shaft 8*a* of the stirrer fan is positioned near a middle of the two slots. Accordingly, a distance between the shaft of the stirrer fan 8 and the slot is approximately λg/4.

The stirrer fan 8, passed through the waveguide 6 and provided to the inside of the cavity 1, induces various modes of standing waves toward the inside of the cavity 1 from the electric field of the standing wave, and varies the microwaves, periodically.

Therefore, the electric field formed by the microwaves radiated toward the inside of the cavity 1 through the slots 7 is induced by the rotating stirrer fan 8 to vary periodically, by which an interfered state of the microwaves vanes.

In the meantime, even though the microwaves have a variety of modes, modes appropriate to heat the food are limited to a certain range. Accordingly, for making uniform heating of the food, it is required to combine amplitudes and phases of the microwaves appropriately, to form desired modes.

For this, the stirrer fan and the plurality of slots are combined appropriately to form microwaves of desired modes. In this instance, by forming the microwaves of desired modes more variously, the food can be heated more uniformly.

There is one or more than one slot 7 on each side of the stirrer fan 8. In this instance, the slots 7 are arranged along a direction of reciprocating movement of the dish 3*a*, and the slots are spaced a distance apart from each other.

As has been described, it is preferable that a distance 'D' between the shaft 8*a* of the stirrer fan 8 and the slot 7 adjacent to the stirrer fan 8 is approximately λg/4. The 'λg' denotes a wavelength of the microwave in the waveguide 6. Accordingly, the shaft 8*a* of the stirrer fan is at a point where the intensity of the electric field of the standing wave is peak.

In the meantime, for heating the food in the cavity 1 more uniformly, it is preferable that, two, or more than two, a plurality of slots 7 are formed.

Besides the two slots 7 shown, it is preferable to form a plurality of slots more in symmetry with reference to the shaft 8*a* of the stirrer fan. In this instance, since the slots are required to be positioned near peak points of the intensity of the magnetic field, the slots are at λg/4 intervals.

The interval condition of the slots is a condition for radiating a strong microwave toward the inside of the cavity 1. Therefore, the interval condition can be changed for adjusting the phase and amplitude of the radiated microwave.

In the meantime, taking characteristics of the magnetic field and the electric field crossing each other into account, the slot 7 has a T form. The slot may have a "¬"form or a straight line form with a predetermined width, or any other form.

The foregoing configuration of the slots and the stirrer fan is applicable to a microwave oven having the turn table applied thereto.

The operation of the microwave oven of the present invention will be described in detail.

The microwave emitted from the magnetron 4 is transmitted through the waveguide 6. The microwave is radiated into the inside of the cavity 1 through the slots 7. The phase and amplitude of the radiated microwave vary with distances between the stirrer fan and the slots, distances between the slots, and size and form of the slot.

The microwave is radiated into the inside of the cavity 1 through the slots 7. There are a plurality of slots 7 at regular intervals along the direction of the linear reciprocating movement of the food regularly such that the microwaves radiated through the slots 7 interfere with one another.

In this instance, an electromagnetic energy in the cavity exists in a form of a proper mode of the cavity. Moreover, the modes (the standing wave distribution) have a variety of forms depending on sizes and forms of the food and the cavity.

In the meantime, an interference state of the microwaves is varied by the rotating stirrer fan 8, periodically. If the stirrer fan 8 over the cavity 1 is rotated, an electric field formed in the cavity is induced and varied. According to this, a mode of the microwave radiated toward the inside of the cavity 1 varies, and at the same time with this, an interference state of the microwaves varies, periodically.

Figure 3:
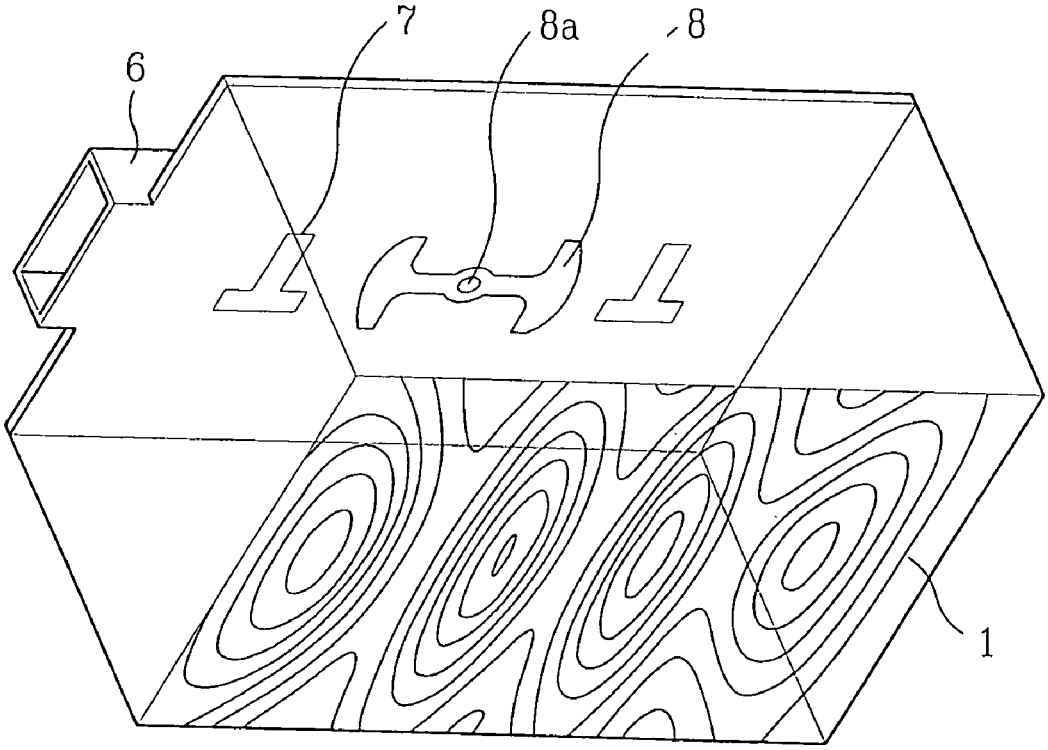
FIG. 3 illustrates a perspective view of a temperature distribution caused by microwave directed to a bottom surface of a cavity of the microwave oven of the present invention.

FIG. 3 illustrates a perspective view of a microwave distribution radiated into a cavity of the microwave oven of the present invention.

Referring to FIG. 3, the microwaves radiated through the slots 7 interfere with one another, and arranged in a lateral direction of the cavity, regularly. That is, the energy of the microwave radiated into the cavity 1 is distributed in the lateral direction of a bottom of the cavity 1 regularly. Therefore, in comparison of a case of a single slot, the microwave is distributed more uniformly in the lateral direction of the cavity 1.

At the same time with this, a distribution of the microwave varies periodically as the stirrer fan 8 is rotated. According to this, it is prevented that the microwave radiated toward a part of the cavity 1 is always concentrated on the part. Moreover, in a case the tray 3 makes linear reciprocating movement, the food can be heated more uniformly.

Referring to FIG. 3, the intensity of the microwave radiated toward the bottom surface of the cavity 1 has a distribution of an interfered waveform. Since the higher the intensity of the microwave, the higher a food heating temperature, the distribution of the microwave is the same with the distribution of the microwave.

Since the microwaves passed through the slots 7 interfere with one another, there is an interfered form of a plurality of microwave circles along a direction of the reciprocating movement of the dish 3*a*. Therefore, if the dish 3*a* is reciprocated, the food can be heated uniformly.

A central part of the microwave circle is the highest temperature area, and the distance between the highest temperature area is shorter than the related art. Therefore, even in a case the food reciprocates as much as the distance of adjacent highest temperature areas, the food can be heated more uniformly. That is, even if a stroke of the tray 3 is small, food can be heated, more uniformly.

As has been described, the microwave oven of the present invention has the following advantages.

First, the microwave oven of the present invention has a plurality of slots provided thereto for lateral wide distribution of the microwaves radiated through the slots along a direction of movement of the food by interference between the microwaves with one another. Moreover, a state of the interfered microwaves varied by the stirrer fan periodically.

That is, by forming a plurality of slots in the waveguide, a plurality of standing wave modes are formed in the cavity, and the standing wave modes are varied further by the stirrer fan. Moreover, regular rotation of the stirrer fan varies the modes, regularly. At the end, by forming more modes by using the plurality of slots and the stirrer fan, the food can be heated more uniformly in a side by side type microwave oven.

Second, even in a general microwave oven, by using the plurality of slots and the stirrer fan at the same time, an amplitude and a phase of the microwave can be adjusted. According to this, the present invention provides improved design freedoms that enables to provide a greater number of combination of the microwaves to suit for heating the food.

Third, the highest temperature areas formed in the cavity at shorter intervals permits uniform heating of the food even if the stroke of the tray is smaller.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A microwave oven comprising:

a cavity for placing food therein;

a magnetron for generating a microwave;

a waveguide having at least two slots for guiding the microwave from the magnetron into the cavity, the at least two slots being formed near peak points of intensity of a magnetic field in the waveguide, respectively, an interval of approximately $\lambda g/2$ being between two adjacent slots of the at least two slots, $\lambda g$ denoting a wavelength of the microwave in the waveguide; and a stirrer fan rotatably mounted on one side of the cavity for varying an interfered state of the microwaves, periodically, the stirrer fan having a rotation shaft located near a peak point of intensity of an electric field in the waveguide, the rotation shaft of the stirrer fan having a distance of approximately $\lambda g/4$ to a closest slot of the at least two slots.

2. The microwave oven as claimed in claim 1, wherein the rotation shaft passes through the waveguide.

3. The microwave oven as claimed in claim 1, wherein the stirrer fan has a rotation shaft provided near a central part of one side of the cavity.

4. The microwave oven as claimed in claim 1, further comprising a tray in the cavity, the tray being reciprocally movable along one direction.

5. The microwave oven as claimed in claim 4, wherein the slots are arranged along the one direction.

6. The microwave oven as claimed in claim 4, further comprising a dish provided on the tray.

7. The microwave oven as claimed in claim 1, wherein the slot has a 'T' form.

8. The microwave oven as claimed in claim 1, wherein the slot has an 'L' form.

9. The microwave oven as claimed in claim 1, wherein the slot has a straight line form with a predetermined width.

10. The microwave oven as claimed in claim 1, wherein the slots are arranged in a longitudinal direction of the cavity such that the microwaves radiated through the slots make inference with one another to form microwave circles along the longitudinal direction, regularly.

* * * * *